US011292054B2

(12) United States Patent
Ormerod

(10) Patent No.: US 11,292,054 B2
(45) **Date of Patent: *Apr. 5, 2022**

(54) LEAD DELIVERY APPARATUS

(71) Applicant: TBS ENGINEERING LIMITED, Gloucester (GB)

(72) Inventor: Mark Ormerod, Cheltenham (GB)

(73) Assignee: TBS ENGINEERING LIMITED, Gloucester (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/901,972

(22) Filed: Jun. 15, 2020

(65) Prior Publication Data

US 2020/0306828 A1 Oct. 1, 2020

Related U.S. Application Data

(63) Continuation of application No. 16/104,462, filed on Aug. 17, 2018, now Pat. No. 10,814,383.

(30) Foreign Application Priority Data

Aug. 18, 2017 (GB) ..... 1713271

(51) Int. Cl.
*B22D 25/04* (2006.01)
*B22D 39/02* (2006.01)
(Continued)

(52) U.S. Cl.
CPC ..... *B22D 25/04* (2013.01); *B22D 17/32* (2013.01); *B22D 35/04* (2013.01); *B22D 39/02* (2013.01); *B22C 9/08* (2013.01); *B22D 21/027* (2013.01)

(58) Field of Classification Search
CPC ..... B22C 9/06; B22D 17/32; B22D 21/027; B22D 25/04; B22D 35/04; B22D 39/02
USPC ..... 164/271, 133, 337
See application file for complete search history.

(56) References Cited

U.S. PATENT DOCUMENTS 5,146,974 A 9/1992 Mayer et al.
5,487,496 A 1/1996 Benson
(Continued)

FOREIGN PATENT DOCUMENTS

CN 202752586 U 2/2013
CN 106216641 A 12/2016
(Continued)

OTHER PUBLICATIONS

Search Report for Great Britain Application No. GB1713271.3, dated Feb. 6, 2018.
(Continued)

*Primary Examiner* — Kevin P Kerns
(74) *Attorney, Agent, or Firm* — Marshall, Gerstein & Borun LLP

(57) ABSTRACT

A lead delivery apparatus for a cast on strap machine is arranged to deliver a predetermined volume of molten lead to a mould. The apparatus includes a first needle valve, a second needle valve, and a housing. The housing has a reservoir including an inlet and an outlet. The reservoir inlet is in fluid communication with a molten lead supply. The reservoir is supplied with molten lead during use such that the molten lead in the reservoir is maintained at a constant height.

20 Claims, 11 Drawing Sheets

(51) Int. Cl.

| | |
|---|---|
| ***B22D 35/04*** | (2006.01) |
| ***B22D 17/32*** | (2006.01) |
| *B22D 21/02* | (2006.01) |
| *B22C 9/08* | (2006.01) |

(56) References Cited

U.S. PATENT DOCUMENTS

| | | | | |
|---|---|---|---|---|
| 10,814,383 | B2 * | 10/2020 | Ormerod | B22D 17/32 |
| 2014/0116637 | A1 | 5/2014 | Barge et al. | |
| 2020/0306826 | A1 * | 10/2020 | Ormerod | B22D 39/02 |
| 2020/0306827 | A1 * | 10/2020 | Ormerod | B22D 35/04 |

FOREIGN PATENT DOCUMENTS

| | | | |
|---|---|---|---|
| DE | 4306414 | A1 | 9/1994 |
| FR | 2495515 | A1 | 6/1982 |
| FR | 2495516 | A1 | 6/1982 |
| GB | 2536295 | A | 9/2016 |
| JP | S58107263 | A | 6/1983 |
| JP | 61-42665 | A | 6/1986 |

OTHER PUBLICATIONS

Search Report for Great Britain Application No. GB1713271.3, dated May 8, 2018.
Further Search Report for Great Britain Application No. GB1713271.3, dated May 8, 2018.
Office Action for U.S. Appl. No. 16/104,462, dated Mar. 20, 2020.

* cited by examiner

LEAD DELIVERY APPARATUS

FIELD OF INVENTION

The present invention generally relates to the forming of battery components and in particular, but not exclusively, to such apparatus for use in manufacturing cast on straps during the manufacture of batteries. More specifically the invention relates to a lead delivery apparatus for a cast on strap machine arranged to deliver a predetermined volume of molten lead to a mould.

CROSS REFERENCE TO RELATED APPLICATION

This application is a continuation application of U.S. Pat. No. 10,814,383, filed Aug. 17, 2018, which is hereby incorporated by reference herein.

BACKGROUND OF INVENTION

In the manufacture of batteries, particularly for example lead acid batteries, it is known to cast connectors known as "straps" and other formations onto the "lugs" (or "tabs") of battery plates. For example, straps are formed to provide a connection between a set of plates within a cell of the battery. Straps are generally cast using a "cast on strap machine" in which a mould cavity is filed with molten metal (normally molten lead) before the lugs of a group of battery plates are dipped into the cavity prior to the cooling of the lead. The mould for forming such straps general comprises a plurality of cavities each configured to form a separate strap across a "pack" or "group" comprising a plurality of battery plates. The mould may for example include a series of generally paired cavities spaced along the length of the mould such that each pair of cavities can form a positive and negative strap for a single group of batteries (and with the mould, therefore, forming a plurality of groups spaced along the length in a single process).

Typically, the mould cavities are filled by allowing lead to flow into channels at the sides of the cavities and spill over a weir into the mould. An example of such a moulding apparatus is shown in the Applicant's earlier published European patent EP0630526. In order to ensure a good connection between the lugs and casting, the lead must remain hot until the lugs are in position. However, in order to minimise cycle time in production, the lead must be cooled as quickly as possible once the plates are in position.

It is important that the volume of lead is carefully measured and controlled during strap casting, because excess lead (for example as a result of mould features such as weirs) will have an impact on both the cost and weight of the final battery produced.

The Applicants previously proposed a further battery moulding apparatus in published UK Patent Application GB2507485, which was later improved upon in UK Patent Application GB2536295. In both of these arrangements a reciprocating sliding block is used to provide an accurately measured volume of lead for each cavity of a mould.

Embodiments of the present invention seek to provide a new battery moulding apparatus and provide an alternative to the arrangement proposed in GB2536295 which may, for example, improve the measuring of molten lead delivered into the mould.

SUMMARY OF INVENTION

According to the first aspect of the present invention there is provided a lead delivery apparatus for a cast on strap machine arranged to deliver a predetermined volume of molten lead to a mould, comprising:

a first needle valve;

a second needle valve;

a housing, the housing comprising:

a reservoir comprising an inlet and an outlet, the reservoir inlet being in fluid communication with a molten lead supply, the reservoir being supplied with molten lead during use such that the molten lead in the reservoir is maintained at a constant height, and the reservoir outlet being defined in a lower portion of the reservoir and being selectively openable and closable by the first needle valve;

a volume block comprising an inlet, an outlet and a through cavity, the volume block inlet being in fluid communication with the reservoir outlet, the volume block inlet located below the reservoir outlet, the through cavity together with the second needle valve defining the predetermined volume of molten lead received from the reservoir via the reservoir outlet, and the volume block outlet being selectively openable and closable by the second needle valve;

wherein the first needle valve is selectively moveable between a first position and a second position, such that in a first position the reservoir outlet is closed and the flow of molten lead between the reservoir and the volume block is prevented, and in a second position the reservoir outlet is open, such that the flow of molten lead between the reservoir and the volume block is permitted until an equilibrium position has been reached, which defines the predetermined volume; and wherein the second needle valve is selectively moveable between a first position and a second position, such that in a first position the volume block outlet is closed and the flow of molten lead between the volume block and a mould is prevented, and in a second position the volume block outlet is open, such that the predefined volume of molten lead is permitted to flow between the volume block and the mould.

Advantageously, the present invention provides a lead delivery apparatus which comprises needle valves to control the flow of molten lead from the supply, through the reservoir and volume block, and into the mould. Advantageously, as will become apparent, the profile of the second needle valve provides an improved seal between the volume block and the mould which significantly reduces leaking, and thus reduces the volume of lead wasted.

The molten lead may be at least partly flowable from the reservoir into the volume block, and also from the volume block into the mould, due to gravity.

The first needle valve and the second needle valve may be angled relative to each other.

The first needle valve may be angled at around 20 degrees to the horizontal axis of the housing. Preferably, the second needle valve is substantially perpendicular to the horizontal axis of the housing.

According to a second aspect of the present invention there is provided a lead delivery apparatus for a cast on strap machine arranged to deliver a predetermined volume of molten metal to a mould comprising:

a housing defining a reservoir having an inlet in fluid communication with a molten lead supply and an outlet;

a volume block having an inlet in fluid communication with the reservoir outlet and an outlet for providing a predetermined volume of molten lead to a mould and a metering cavity defined therebetween;

wherein the housing defines a sealed ullage space extending over the molten lead within the reservoir and the metering cavity of the block is in fluid communication with the ullage space; and a supply of inert gas in fluid communication with the ullage space.

The features of the lead delivery apparatus of the second aspect of the invention are the same as described above with regards to the first aspect of the invention.

The first and/or second needle valves may each comprise a gas seal, such as a Nitrogen seal, located at the intersection between the first and/or second needle valves and the housing.

The first needle valve may comprise an elongate body and a sealing portion. The sealing portion may have a profile corresponding to the profile of the reservoir outlet. The sealing portion may comprise a flat end positioned flush with an end of the reservoir outlet. Preferably, the end of the reservoir outlet corresponds to the volume block inlet.

The second needle valve preferably comprises an elongate body and a seat engaging portion. The seat engaging portion may comprise a first section having a profile corresponding with the profile of the volume block outlet, such that the first section and the volume block outlet interlock when the second needle valve is in the first position to prevent the flow of molten lead between the volume block and the mould.

The seat engaging portion preferably comprises a second section protruding beyond the volume block outlet when the second needle valve is in the first position. The volume block outlet may be located within a recess on an exterior surface of the volume block. The second section preferably protrudes into said recess when the second needle valve is in the first position.

In some embodiments, the second needle valve may be made of stainless steel or carbon steel. In such embodiments, at least a portion of the second needle valve may comprise a metal nitride coating. For example, at least the first and/or second sections of the seat engaging portion may comprise a metal nitride coating. At least a part of the surface of the through cavity may also comprise a metal nitride coating. The volume block outlet may also comprise a metal nitride coating. The metal nitride coating may be one or more of: Titanium Nitride, Chromium Nitride, Chromium Aluminium Nitride, and Titanium Aluminium Nitride.

It may be an advantage of embodiments of the present invention that the metal nitride coating can help to reduce friction of the surfaces on which the coating is applied, which helps to prevent or at least reduce the amount of molten lead sticking to these surfaces, e.g. the surface of the second needle valve, the surface of the through cavity and/or the volume block outlet.

In another embodiment, the second needle valve may be made of titanium. In such embodiments, a metal nitride coating may not be required. It may be an advantage of embodiments of the present invention that making the second needle valve out of titanium can itself help to reduce friction of the surface of the second needle valve, which in turn helps to prevent or at least reduce the amount of molten lead sticking to the surface of the second needle valve.

The second section may comprise an elongate portion and a substantially tapered portion. The substantially tapered portion may extend along the longitudinal axis of the elongate portion. In an embodiment, the substantially tapered portion may be inverted, and extend internally within the elongate portion. The internally extending tapered portion may form a cavity within the elongate portion.

In an alternative embodiment, the substantially tapered portion may extend externally away from the elongate portion. The externally extending tapered portion may protrude into said recess when the second needle valve is in the first position such that the second section is fully confined within the recess. The elongate portion preferably protrudes beyond the volume block outlet by at least around 0.5 mm to around 1 mm.

The elongate body preferably comprises an upper section furthest from the seat engaging portion having a greatest diameter. The elongate body also preferably comprises a lower section located between the upper section and the seat engaging portion having the same greatest diameter or one or more relatively different diameters, such as relatively smaller diameters. When the second needle valve is in the first position, the part of the through cavity immediately surrounding the upper section may have a diameter which provides a narrow clearance gap between the upper section and said part of the through cavity. The narrow clearance gap may define a metering space.

The second needle valve may be removable and interchangeable with a different second needle valve. The volume block may also be removable and interchangeable with a different volume block. Each different volume block may have a different volume defined by its through cavity. Each different through cavity together with each different second needle valve may define a different predetermined volume of molten lead received from the reservoir via the reservoir outlet.

The predetermined volume of molten lead received from the reservoir via the reservoir outlet may be from 0.06 kg up to 0.25 kg. The predetermined volume of molten lead may be changed by removing the second needle valve and replacing with a different needle valve having a different profile and/or removing the volume block and replacing with a different volume block having a different sized through cavity.

Preferably, the reservoir comprises an inert atmosphere, such as Nitrogen, above the molten lead. Furthermore, the volume block may also comprise an inert atmosphere, such as Nitrogen, above any molten lead in the through cavity. When the second needle valve is in the second position, the volume of inert atmosphere in the through cavity may increase as the volume of molten lead in the through cavity decreases.

The reservoir inlet may be constantly open, such that the molten lead is constantly replenished and maintained at said constant height.

According to a third aspect of the present invention there is provided a lead delivery apparatus for a cast on strap machine arranged to deliver a predetermined volume of molten lead to a mould, comprising:

a needle valve comprising an elongate body and a seat engaging portion; and a volume block comprising an inlet, an outlet and a through cavity, the volume block inlet being in fluid communication with a supply of molten lead, the through cavity together with the needle valve defining the predetermined volume of molten lead received from the supply, and the volume block outlet being selectively openable and closable by the needle valve;

wherein the elongate body comprises an upper section furthest from the seat engaging portion having a greatest diameter, and a lower section between the upper section and the seat engaging portion having the same greatest diameter or one or more relatively different (e.g. smaller) diameters; and wherein when the volume block outlet is closed by the needle valve, the part of the through cavity immediately surrounding the upper section has a diameter which provides a clearance gap between the upper section and said part of the through cavity.

The features of the lead delivery apparatus of the third aspect of the invention are the same as described above with regards to the first and second aspects of the invention.

Advantageously, as will be explained further in the examples, the clearance gap is narrow, and may provide a more accurate measurement of the predefined volume due to an improvement in the tolerance. The clearance gap may also help to prevent the needle valve from sticking, thus reducing the risk that the volume block outlet will not fully open and release the full predefined volume of molten lead. Furthermore, the clearance gap may also help to prevent a vacuum effect within the through cavity, which could otherwise hinder the release of molten lead from the through cavity into the mould.

The clearance gap may define a metering space. The lead delivery apparatus may further comprise a reservoir comprising an inlet and an outlet. The reservoir may be supplied with molten lead during use such that the molten lead in the reservoir may be maintained at a constant height. The molten lead may be flowable from the reservoir to the volume block until the level of molten lead in the volume block is substantially the same as the constant height level of molten lead in the reservoir.

Said level of molten lead in the volume block is preferably located within the clearance gap.

According to a fourth aspect of the present invention there is provided a lead delivery apparatus for a cast on strap machine arranged to deliver a predetermined volume of molten lead to a mould, comprising:

a needle valve comprising an elongate body and a seat engaging portion; and a volume block comprising an inlet, an outlet and a through cavity, the volume block inlet being in fluid communication with a supply of molten lead, the through cavity together with the needle valve defining the predetermined volume of molten lead received from the supply, and the volume block outlet being selectively openable and closable by the needle valve;

wherein the seat engaging portion comprises a first section having a profile corresponding with the profile of the volume block outlet, such that the first section and the volume block outlet interlock when the volume block outlet is closed by the needle valve; and a second section protruding beyond the volume block outlet when the volume block outlet is closed by the needle valve.

The features of the lead delivery apparatus of the fourth aspect of the invention are the same as described above with regards to the first, second and third aspects of the invention.

Advantageously, the interlock feature between the needle valve and the volume block outlet may help to provide a tighter seal between the volume block and the mould, compared to known lead delivery apparatuses. Furthermore, the tight fit between these features can help to "squeeze" out any remaining molten lead from the base of the through cavity and into the mould. This can help to ensure the correct predetermined volume is being released into the mould, within the improved tolerances. It may also be an advantage of embodiments of the present invention that the part of the needle valve protruding beyond the volume block outlet can help to prevent tails of molten lead from forming on the protruding part by "flicking" them off and into the mould due to the force of the needle valve closing the volume block outlet.

The seat engaging portion preferably comprises a first tapered portion, a second tapered portion, the first and second tapered portions connected by an elongate portion. The first section may comprise the first tapered portion and a substantial part of the elongate portion. The second section may comprise the second tapered portion and the remaining part of the elongate portion.

The second tapered portion may extend along the longitudinal axis of the elongate portion. The second tapered portion may extend internally into the elongate portion, forming a cavity within the elongate portion. The second tapered portion may alternatively extend externally away from the elongate portion.

The remaining part of the elongate portion preferably protrudes beyond the volume block outlet from around 0.5 mm to around 1 mm.

According to a fifth aspect of the present invention there is provided a cast on strap machine comprising:

a lead delivery apparatus as substantially described herein;

a battery plate positioning device;

a mould comprising a plurality of mould cavities; and a mould loading apparatus arranged to move the mould between an in use configuration and a configuration in which the mould is external to the cast on strap machine to allow access to the mould.

Whilst the invention has been described above, it extends to any inventive combination set out above, or in the following description or drawings.

BRIEF DESCRIPTION OF THE DRAWINGS

The invention may be performed in various ways, and an embodiment thereof will now be described by way of example only, reference being made to the accompanying drawings, in which.

DETAILED DESCRIPTION OF THE DRAWINGS

Figure 1:
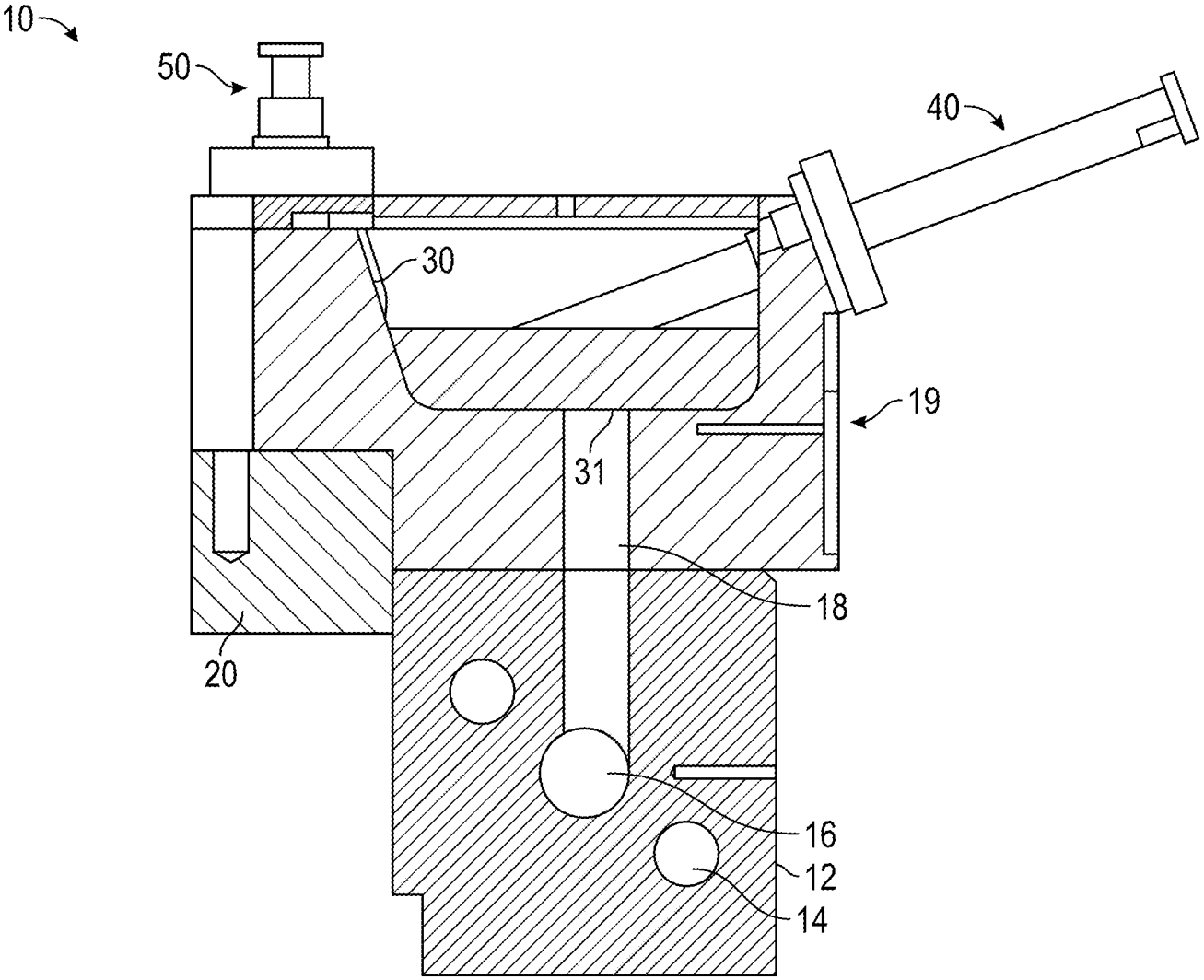
FIG. 1 shows a cross-section of a lead delivery apparatus in accordance with embodiments of the present invention.
Figure 2:
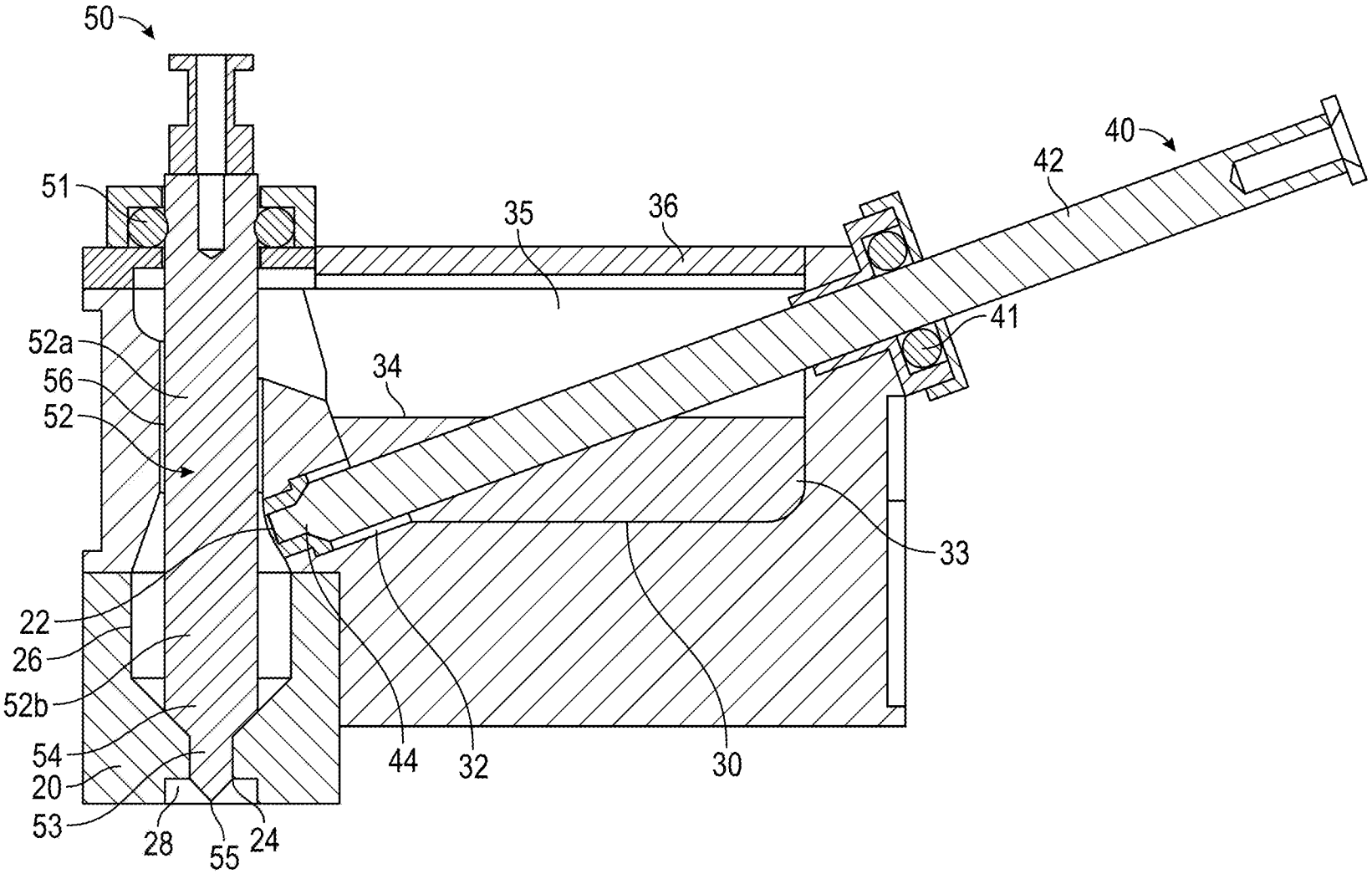
FIG. 2 shows a further cross-section of a lead delivery apparatus in accordance with embodiments of the present invention.

FIGS. 1 and 2 show a lead delivery apparatus 10 for a cast on strap machine arranged to deliver a predetermined volume of molten lead into a mould. The lead delivery apparatus 10 comprises a housing 19 having a removable cover 36, and comprising a reservoir 30 and a volume block 20. A first needle valve 40 extends through the housing 19 and the reservoir 30, whereas a second needle valve 50 extends through the housing 19 and the volume block 20.

The reservoir 30 comprises an inlet 31 and an outlet 32. The inlet 31 (as seen in the cross-section of FIG. 1) is located in the base of the reservoir 30, and is fluidly connected to a feedpipe 12 via a riser 18. The feedpipe 12 comprises a supply pipe 16 and a heater pipe 14 which in use will heat the feedpipe 12 in order to keep the lead molten so it can easily flow from the source to the reservoir 30. During use, the reservoir 30 is supplied with molten lead 33. The molten lead 33 in the reservoir is continually replenished during use and maintained at a constant height 34 (at a constant lead fill level) at all times. This is achieved by keeping the reservoir inlet 31 open, so that the reservoir 30 is in constant fluid communication with the molten lead supply (which is a 'constant head' lead supply).

The cover 36 encloses the reservoir 30 but is spaced apart from the lead fill level 34 of the reservoir 30, thus creating an ullage space 35 above the molten lead 33. The ullage space 35 comprises an inert atmosphere, such as Nitrogen, which helps to prevent the build up of oxides (which may otherwise form on the surface of the lead and accumulate on parts of the lead delivery apparatus).

The reservoir outlet 32 is located in a lower corner of the reservoir 30 and comprises a bore which fluidly connects the reservoir 30 to the volume block 20. As will be described in more detail below, the reservoir outlet 32 is selectively openable and closable by the first needle valve 40.

The volume block 20 comprises an inlet 22, an outlet 24 and a through cavity 26. The inlet 22 is in fluid communication with the reservoir outlet 32 via the bore, such that the end of the bore closest to the volume block 20 corresponds to the volume block inlet 22.

The exterior surface of the volume block 20 comprises a recess 28. The outlet 24 is located within the recess 28, such that it is set back from the exterior surface of the volume block 20. As will be described in more detail below, the volume block outlet 24 is selectively openable and closable by the second needle valve 50.

The through cavity 26 fluidly connects the volume block inlet 22 and the volume block outlet 24. The through cavity 26 also defines a predetermined volume of molten lead 33 to be received from the reservoir 30 via the reservoir outlet 32. The middle portion of the through cavity 26 has the largest diameter, and has a substantially circular cross-section (when viewed from above).

Figure 10:
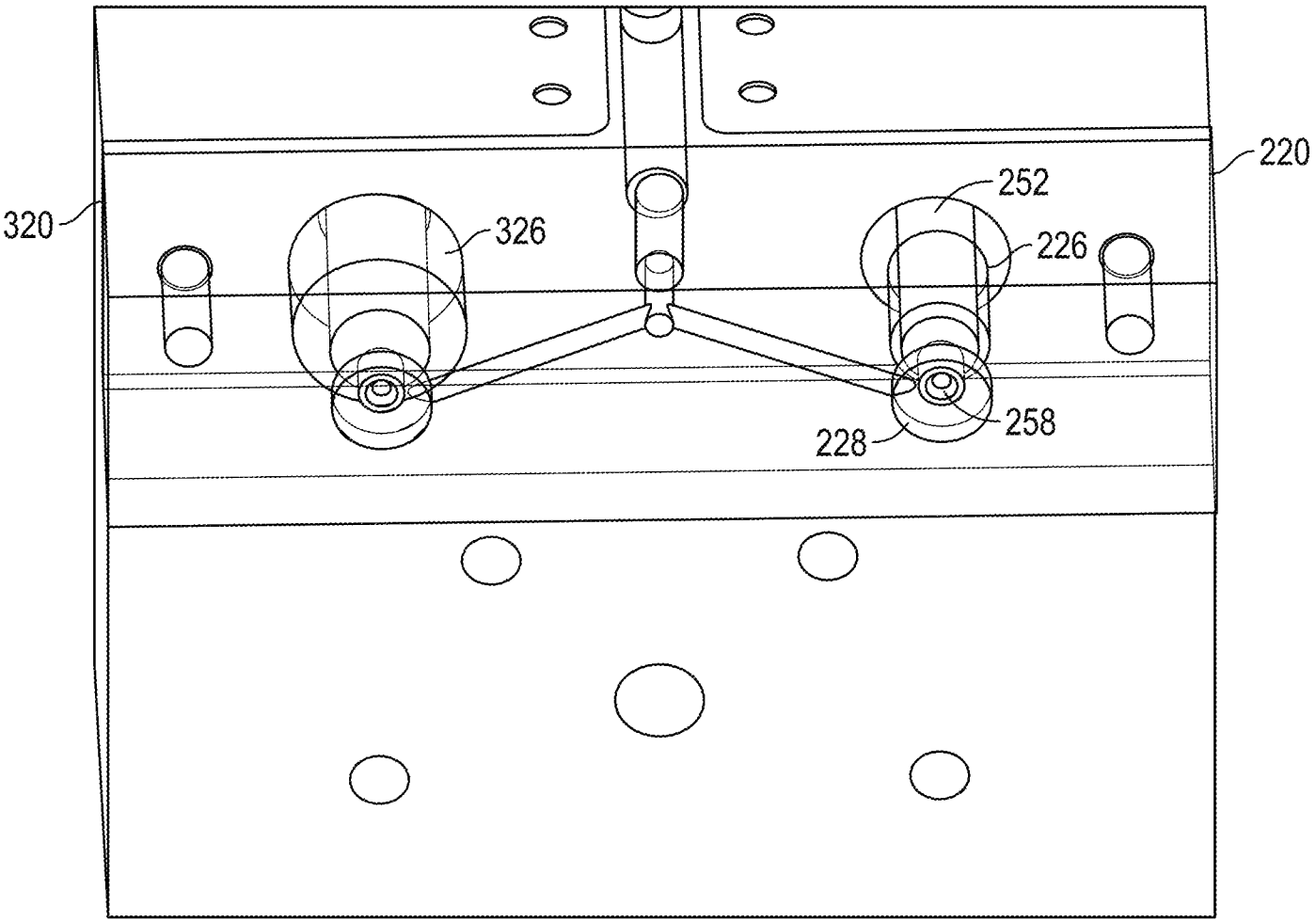
FIG. 10 shows a perspective view of the FIG. 9 sealing mechanism.
Figure 11:
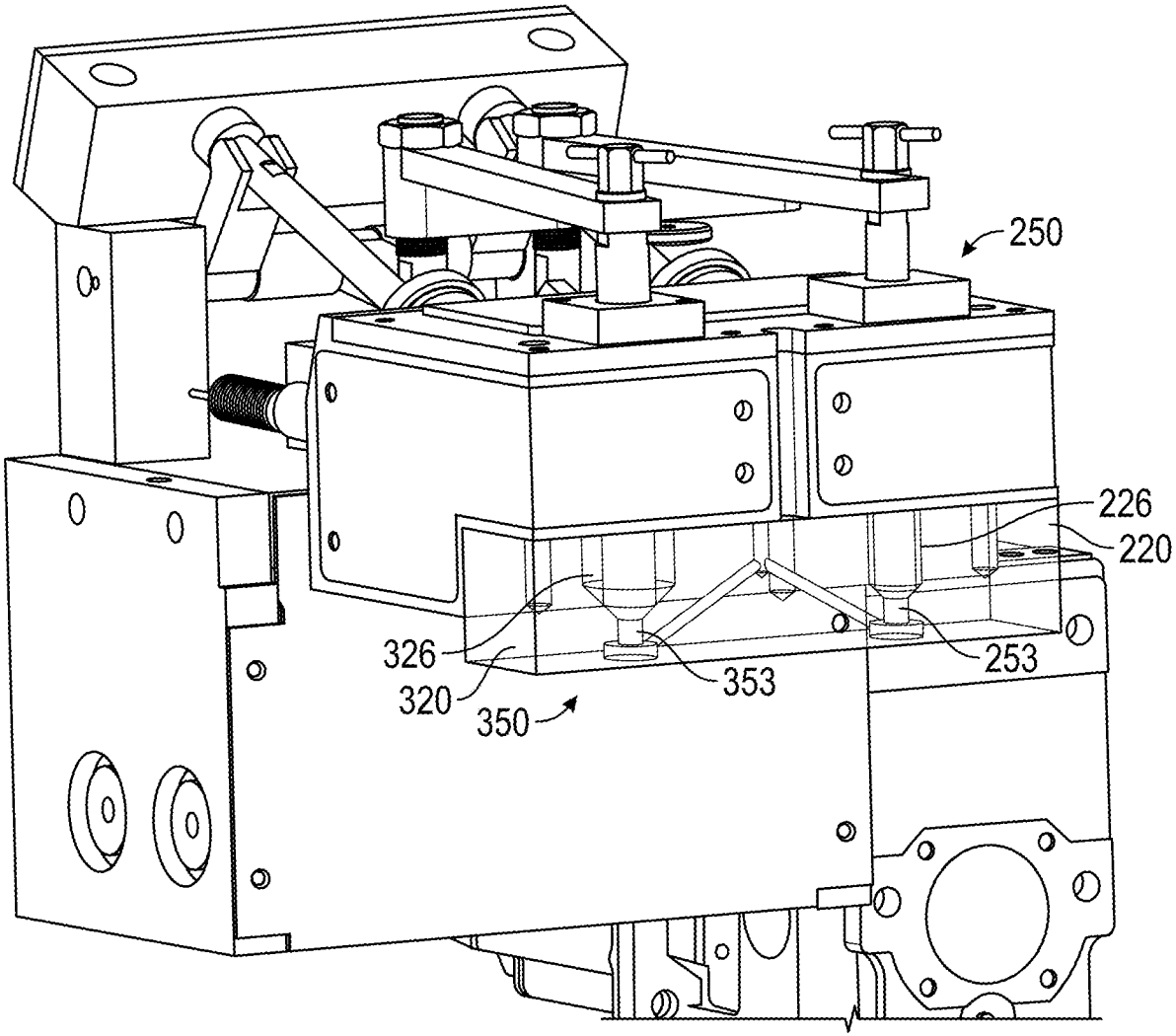
FIG. 11 shows a perspective view of a lead delivery apparatus incorporating the FIG. 9 sealing mechanism.

As will be described in more detail below, the predetermined volume of molten lead can be from 0.06 kg up to 0.25 kg. The second needle valve 50 is interchangeable with needle valves having different profiles (as can be seen, for example, by comparing FIG. 2 and FIG. 7). The volume block 20 is also interchangeable with volume blocks having different sized through cavities (as can be seen in FIGS. 10 and 11). The predetermined volume metered by the apparatus corresponds to the difference between the volume of the through cavity 26 and the volume occupied by the second needle valve 50 in its closed position. For example, a narrower profile (a smaller diameter) will increase the available space within the through cavity 26 for filling with molten lead, thus increasing the predetermined volume. Advantageously, having an interchangeable volume block and an interchangeable second needle valve allows the apparatus to process a wide range of battery sizes.

The ullage space 35 above molten lead 33 in reservoir 30 extends into the volume block 20. In use, the molten lead 25 in the through cavity 26 is filled to a pre-determined level (which is where the lead level in the both the through chamber and the reservoir are in equilibrium). The Nitrogen in ullage space 35 is then drawn into the through cavity 26 and accommodates the area 27 above said equilibrium level.

At the intersection between the housing 19 and the first needle valve 40, there is a Nitrogen seal 41. This helps to prevent the Nitrogen within the ullage space 35 from escaping and potentially being replaced with Oxygen rich air. It is a known problem that Oxygen can cause the lead to oxidise, thus causing oxides to form and build up within the reservoir. Over time, the build up of oxides can cause a reduction in the available volume within the reservoir for filling with molten lead.

The first needle valve 40 extends through the housing 19 and into the reservoir 30 at an angle of around 20 degrees to the horizontal axis of the housing 19. Advantageously, having the first needle valve at an angle to the horizontal axis of the housing, helps to keep the Nitrogen seal away from the molten lead in the reservoir. Furthermore, a vertical first needle valve would require a much larger volume block and through cavity, which would take up more space.

The first needle valve 40 comprises an elongate body 42 and a sealing portion 44. The sealing portion 44 has a profile corresponding to the profile of the bore of the reservoir outlet 32, that is the sealing portion 44 is partially tapered. The sealing portion 44 also comprises a flat end, which in use when the first needle valve 40 closes the reservoir outlet 32, is positioned flush with an end of the bore of the reservoir outlet 32. In use, the first needle valve 40 is moveable between a first or extended position (shown in FIG. 2) and a second or retracted position (shown in FIG. 3). In the first position the reservoir outlet 32 is closed and the flow of molten lead 33 between the reservoir 30 and the volume block 20 is prevented. In the second position the reservoir outlet 32 is open, permitting the flow of molten lead 33 between the reservoir 30 and the volume block 20. The reservoir outlet 32 remains open until the predetermined volume has been reached.

The second needle valve 50 extends through the housing 19 and the volume block 20, and is substantially perpendicular to the horizontal axis of the housing 19. The first needle valve 40 and the second needle valve 50 are angled relative to each other, such that the volume block inlet 22 is located below the reservoir outlet 32.

At the intersection between the housing 19 and the second needle valve 50, there is a Nitrogen seal 51. This helps to prevent the Nitrogen within the area 27 from escaping and potentially being replaced with Oxygen, thus having the same consequences as detailed above. In this case, the build up of oxides will cause a reduction in the available volume within the through cavity, thus the through cavity will not be able to accommodate the predetermined volume of molten lead required for filling a particular mould. During the cast on process, the only time that Oxygen comes into contact with the molten lead is after it has been released into the mould.

The second needle valve 50 comprises a seat engaging portion 53 and an elongate body 52. The seat engaging portion 53 comprises a first section 54 and a second section 55. The first section 54 has a profile corresponding with the profile of the volume block outlet 24, that is there is a first tapered portion 57, followed by a substantial part of an elongate portion 59 (see FIG. 3). This allows the first section 54 and the volume block outlet 24 to interlock or engage in use when the second needle valve 50 closes the outlet 24. The profile of the second section 55 comprises the remainder of the elongate portion 59 followed by a second tapered portion 58 (see FIG. 3). In this embodiment, the second tapered portion 58 extends away from the elongate portion 59 towards a point. The widest part of the second tapered portion 58 is at the base of the elongate portion 59, with the narrowest part, the tip of the second tapered portion 58, located externally from the elongate portion 59 along a longitudinal axis of the second needle valve 50.

In use, when the second needle valve 50 closes the outlet 24, the elongate portion 59 of the second section 55 protrudes by around 1 mm beyond the volume block outlet 24 and into the recess 28. In use, the tip of the second tapered portion 58 is located in line with the exterior surface of the volume block 20, as shown in FIG. 2. The elongate body 52 comprises an upper section 52*a* which is located furthest from the seat engaging portion 53. The greatest diameter of the second needle valve 50 is along the upper section 52*a*. The elongate body 52 also comprises a lower section 52*b* which is located between the upper section 52*a* and the seat engaging portion 53. The lower section 52*b* has the same diameter as the upper section 52*a* in this embodiment, but in other embodiments, such as that shown in FIGS. 7 and 8, the lower section can have one or more different diameters. In fact, an advantage of embodiments of the present invention may be that the second needle valve is removable and interchangeable. This can allow the second needle valve of FIG. 2 to be replaced with the second needle valve of FIG. 7, for example. As previously mentioned, the narrower diameter(s) of the lower section creates more available space in the through cavity to fill with molten lead from the reservoir.

When the second needle valve 50 closes the outlet 24, the part of the through cavity 26 immediately surrounding the upper section 52*a* of the second needle valve 50 has a diameter only slightly greater than the diameter of the upper section 52*a*. This creates a narrow clearance gap 56 between the upper section 52*a* and the through cavity 26. Such a clearance gap 56 defines a metering space, which advantageously improves the tolerance of the predetermined volume. For example, by providing the clearance gap in line with the fill level of the reservoir, the equilibrium level will be located within the region of the clearance gap, thus any changes in volume of the reservoir will only affect the predetermined volume in the volume block by an insignificant amount, thus improving the accuracy of the measured predetermined volume.

Figure 5:
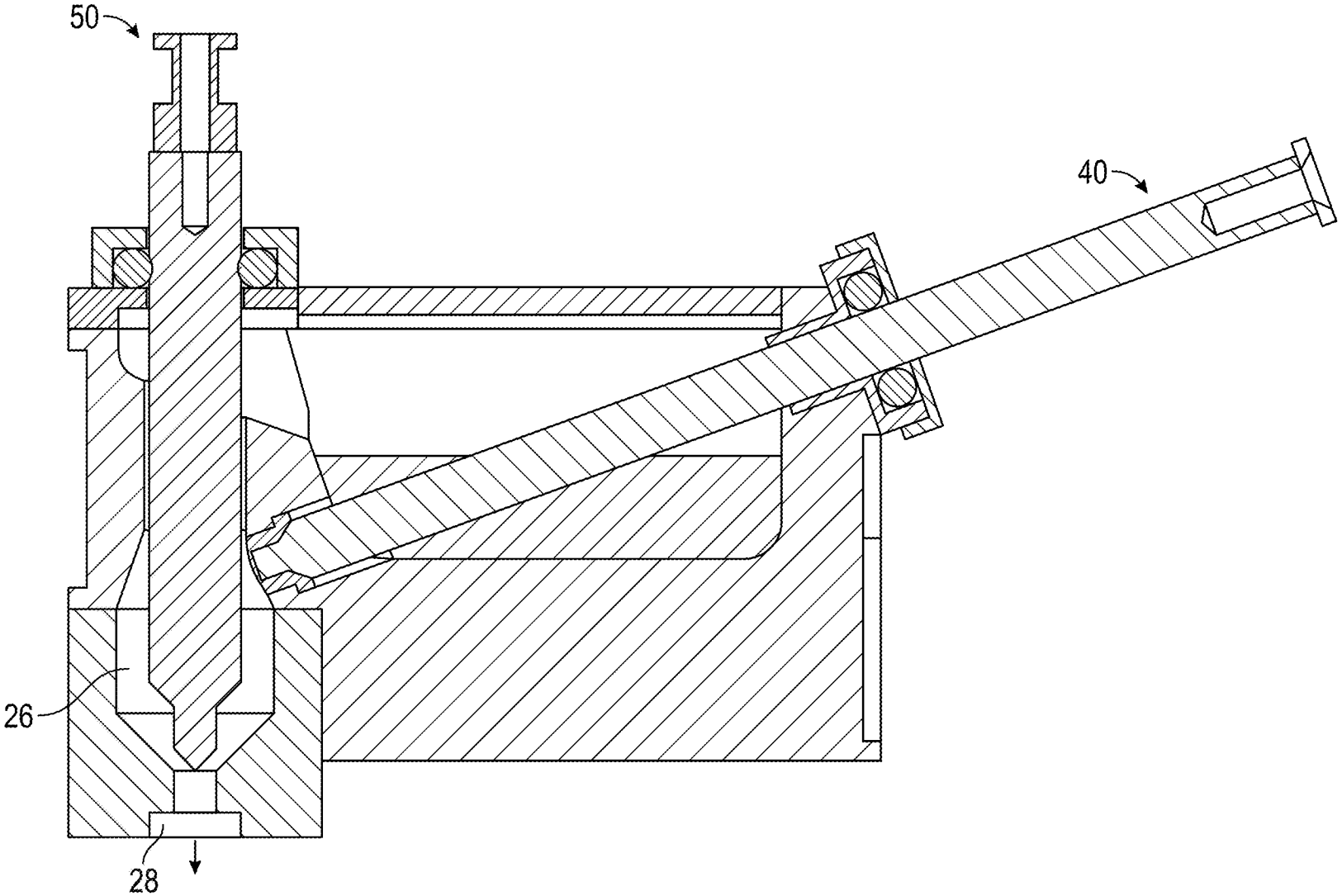
FIG. 5 shows a third stage of the moulding process whereby the molten lead in the volume block of the FIG. 4 lead delivery apparatus is released into a mould in accordance with embodiments of the present invention.

In use, the second needle valve 50 is moveable between a first or extended position (shown in FIG. 3) and a second or retracted position (shown in FIG. 5). In the first position the volume block outlet 24 is closed, thus preventing the flow of molten lead between the volume block 20 and the mould (not shown). In a second position the volume block outlet 24 is open, permitting the predefined volume of molten lead to flow between the volume block 20 and the mould.

FIGS. 3 to 6 show the lead delivery apparatus 10 in use.

Figure 3:
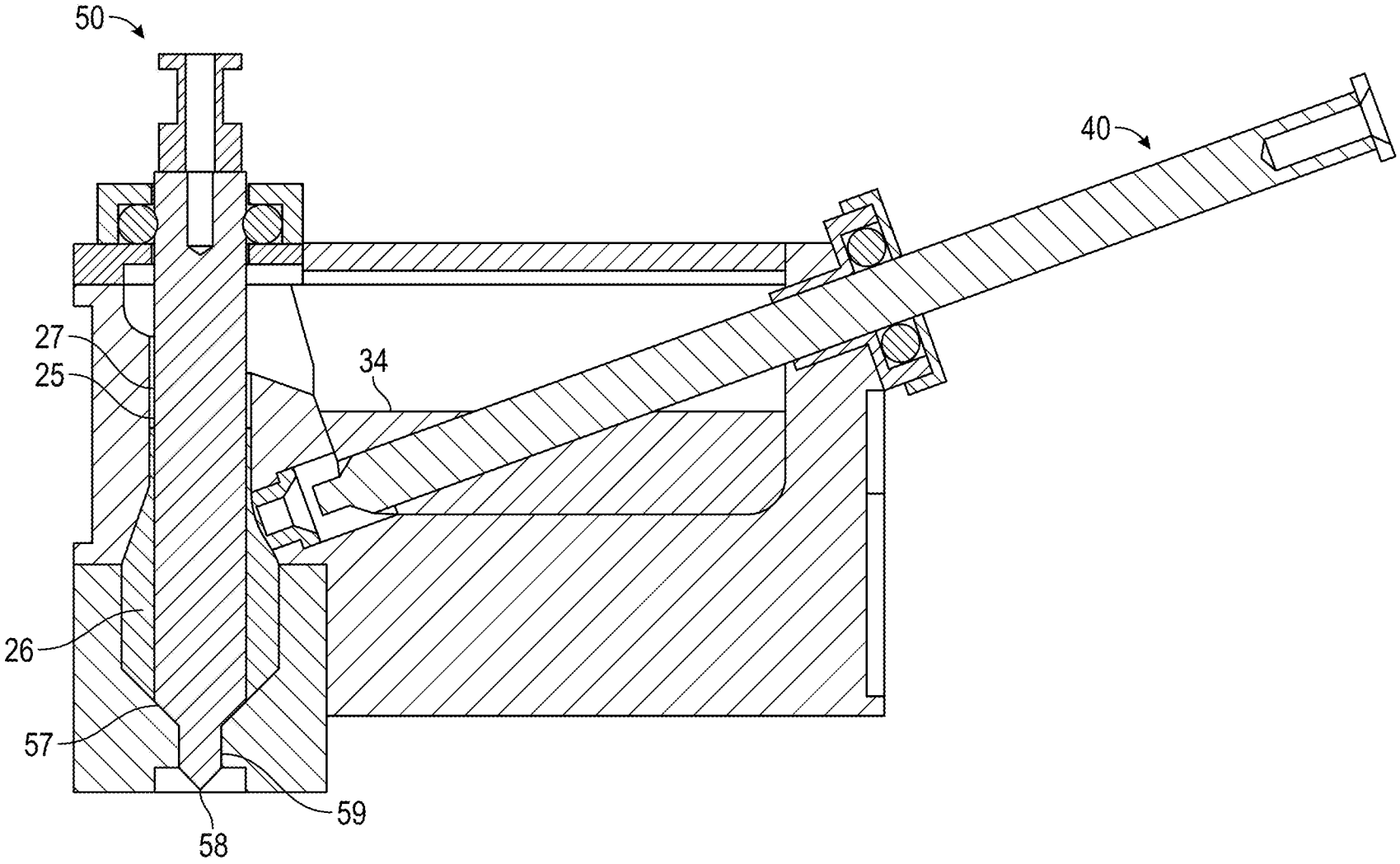
FIG. 3 shows a first stage of a moulding process whereby the volume block of the FIG. 2 lead delivery apparatus is in the process of being filled with molten lead in accordance with embodiments of the present invention.

FIG. 3 shows the first stage of the process. Initially, both the first and second needle valves 40, 50 are in their respective first positions, such that there is no flow of molten lead between the reservoir and the volume block, nor the volume block and the mould. The reservoir 30 is then filled with molten lead 33 from the supply until the lead fill level 34 is reached.

The first needle valve 40 is then moved into its second/retracted position, such that molten lead 33 is allowed to flow between the reservoir 30 and the volume block 20. Since the reservoir outlet 32 is located above the volume block inlet 22, the molten lead 33 flows from the reservoir 30 into the volume block 20, (and also from the volume block 20 into the mould) at least partly due to gravity.

The molten lead 33 flows into the through cavity 26, and fills up the through cavity 26 until the levels reach equilibrium and thus the predetermined volume is reached. As the molten lead 33 is flowing out of the reservoir 30 and into the through cavity 26, the feedpipe 12 continually replenishes the molten lead 33 within the reservoir, thus maintaining the molten lead 33 at the lead fill level 34 at all times.

The predetermined volume corresponds with the lead fill level 34. Therefore, the molten lead 33 flows from the reservoir 30 to the volume block 20 until the level of molten lead level 25 in the volume block 20 is substantially the same as the lead fill level 34 in the reservoir 30. The level 25 in the volume block 20 is located within the clearance gap 56. Advantageously, this may improve the tolerance of the volume measurements because if the lead fill level 34 of the molten lead 33 in the reservoir 30 were to increase, the level of molten lead 25 in the volume block will also increase. However, the volume of molten lead required to increase the lead fill level 34 in the reservoir 30 is much greater than the volume of molten lead required to increase the level 25 in the volume block by the same amount. Therefore, any changes in the volume of the reservoir 30 will only affect the predetermined volume in the volume block 20 by an insignificant amount (such as a difference of only tenths of a gram).

It may be an advantage of embodiments of the present invention that there is no seal provided between the reservoir and the volume block. It is difficult to provide a lead seal in such a location, however the inventors of the present invention have taken full advantage of these difficulties and designed the lead delivery apparatus to function without a seal. For example, not providing such a seal allows the balancing of the lead levels in the reservoir and the volume block, which are carefully defined such that a predetermined volume of molten lead is provided to the moulds. Furthermore, a lack of sealing allows Nitrogen to be drawn into at the top of the through cavity from the reservoir to fill the ullage space above the molten lead. Not only does this help to prevent the build-up of oxides, but drawing in Nitrogen at the top of the through cavity can also help to push the molten lead out of the through cavity and into the mould.

Figure 4:
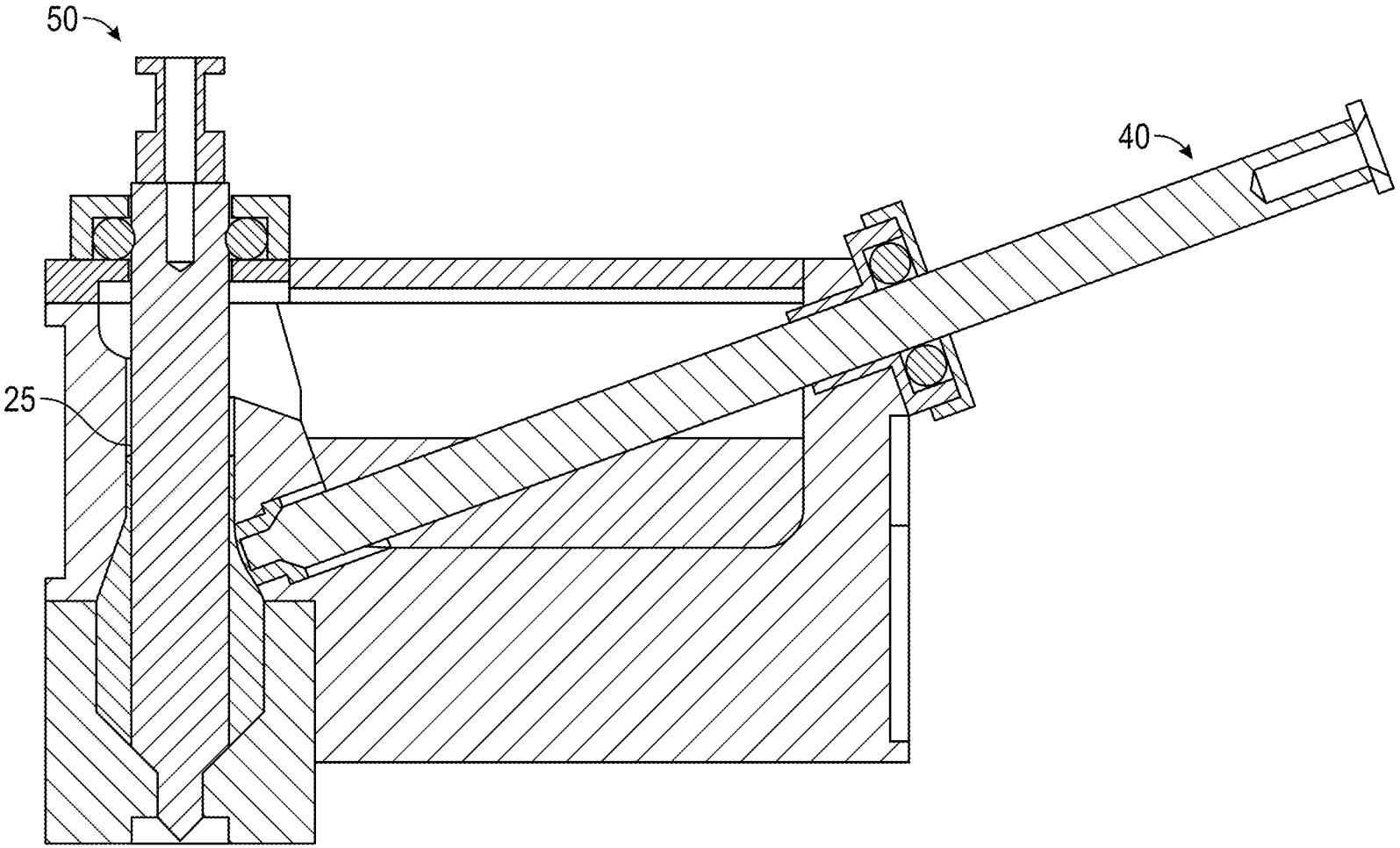
FIG. 4 shows a second stage of the moulding process whereby the filling of the volume block of the FIG. 3 lead delivery apparatus is complete in accordance with embodiments of the present invention.

FIG. 4 shows the second stage of the process, whereby the through cavity 26 has been filled with molten lead to the level 25 corresponding to the lead fill level 34 in the reservoir 30. Once the levels 25, 34 have stabilised, the first needle valve 40 is moved to its closed/extended position. The corresponding and interlocking profiles between the volume block outlet 24 and the seat engaging portion 53 provides a tight seal which helps to mitigate the risk of molten lead leaking from the through cavity 26, which is a known problem with known lead delivery apparatus.

FIG. 5 shows the third stage of the process. With the first needle valve 40 in its closed/extended position, the second needle valve 50 is then moved to its open/retracted position. In this position, the volume block outlet 24 is open, and the molten lead within the through cavity 26 can now drain out of the volume block 20 and into the mould (not shown).

As the volume of molten lead 25 in the through cavity 26 decreases, the volume of the area 27 increases. Therefore, as the molten lead drains out of the volume block 20, it is replaced with an inert atmosphere, such as Nitrogen which is drawn in to the top of the through cavity via a gas inlet (not shown) provided at the rear of the housing 19 and/or from the ullage space 35 above the reservoir 30. Advantageously, drawing Nitrogen in at the top of the through cavity can help to push the molten lead out of the through cavity and into the mould. This arrangement helps to avoid any vacuum effect which may hinder the release of the lead from within the through cavity.

A further advantage of embodiments of the present invention is that the narrow gap helps to prevent the second needle valve seizing or sticking within the through cavity.

Figure 6:
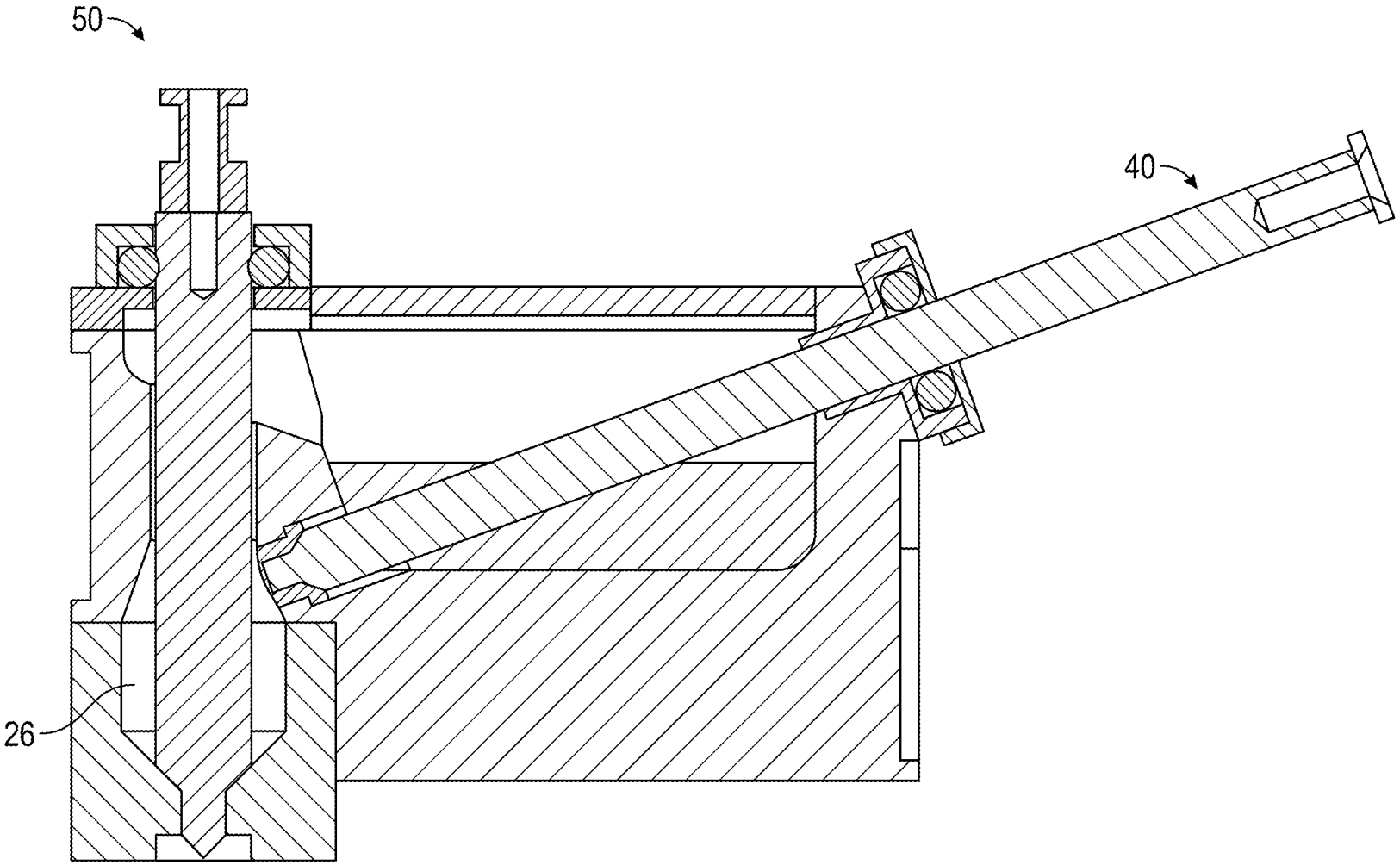
FIG. 6 shows a fourth stage of the moulding process of FIGS. 3-5, whereby the process is complete, in accordance with embodiments of the present invention.

FIG. 6 shows the final stage of the process, whereby all the molten lead within the volume cavity 26 has been released, and second needle valve is subsequently moved into its first/extended position to close the volume block outlet 24.

The volume block outlet 24 and the seat engaging portion 53 fit tightly together due to their corresponding profiles. Therefore, as the second needle valve 50 is closes, any remaining molten lead within the through cavity 26 is essentially "squeezed" out. Furthermore, the profile of the second section 55 of the seat engaging portion 53 (the elongate portion and the tapered portion) protruding beyond the volume block outlet 24 and into the recess 28 causes the remaining molten lead to be forcefully flicked off the end of the second section. This helps to prevent a "tail" of molten lead hanging from the second section. Advantageously, the profile of the seat engaging portion 53 helps to minimise the amount of molten lead remaining within the through cavity 26, thus helping to increase the accuracy of the volume of lead dispensed into the mould.

Since the second section 55 of the seat engaging portion 53 does not extend beyond the confines of the recess 28, the recess 28 acts as a shroud for the tapered portion. This can help to not only protect the end of the needle valve, but also help to ensure the molten lead is flicked off into the mould.

Making the second needle valve out of titanium helps to reduce the surface friction of the second needle valve. Alternatively, if the second needle valve is made from stainless steel or carbon steel, then a metal nitride coating can be applied to the surface of the second needle valve, in particular the second section of the seat engaging portion, to reduce the surface friction. The ability to flick the molten lead off into a mould is greatly improved as the amount of friction provided by the surface of the second needle valve is reduced.

Figure 7:
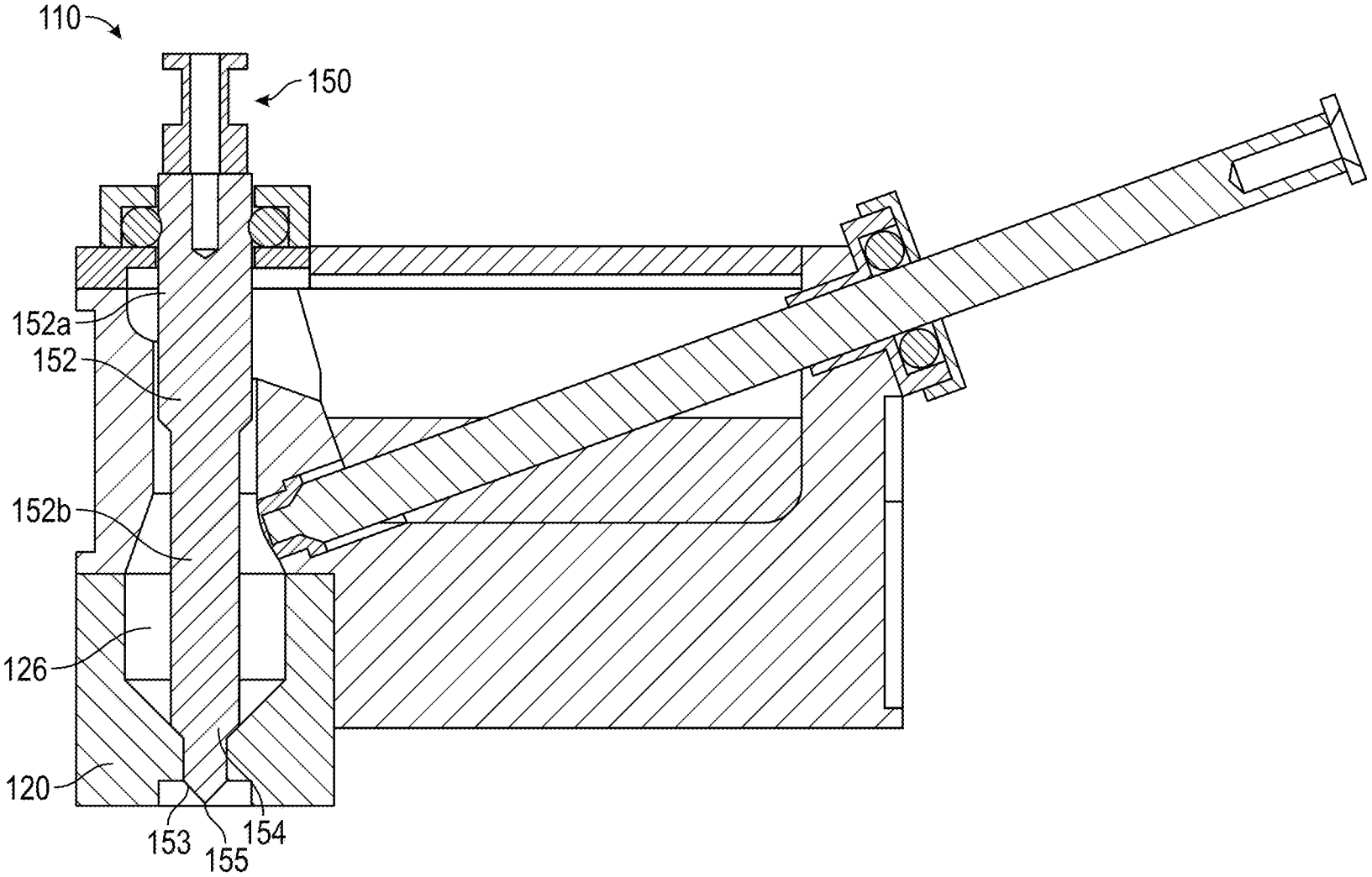
FIG. 7 shows a cross-section of a lead delivery apparatus in accordance with further embodiments of the present invention.

FIG. 7 shows an alternative embodiment of the lead delivery apparatus 110. This embodiment comprises a volume block 120 and a second needle valve 150 with a different, narrower, profile then the second needle valve 50 shown in FIGS. 2 to 6. The second needle valve of the present invention is interchangeable with other second needle valves having different profiles and dimensions, however, the apparatus works in exactly the same way as described above in FIGS. 3 to 6.

The second needle valve 150 comprises a seat engaging portion 153 and an elongate body 152. Similar to the previous embodiment, the seat engaging portion 153 comprises a first section 154 and a second section 155 which are exactly the same as described above. The first section 154 comprises a first tapered portion 157 and a substantial part of an elongate portion 159, and the second section 155 comprises a second tapered portion 158 and the remaining part of the elongate portion 159.

The elongate body 152 comprises an upper section **152*a* which is located furthest from the seat engaging portion 153. As before, the greatest diameter of the second needle valve 150 is along the upper section 152*a*. The elongate body 152 also comprises a lower section 152*b* which is located between the upper section 152*a* and the seat engaging portion 153. In this embodiment, the lower section 152*b* has a single smaller diameter than the upper section 152*a*, giving the second needle valve 150 a narrower profile. Having a narrower profile creates more available space in the through cavity 126 to fill with molten lead from the reservoir. This increases the predetermined volume accommodated in the through cavity 126, and subsequently released into the mould. This is particularly beneficial if, for example, the cast on strap machine was required to process larger batteries, because larger straps would need to be cast on which would require larger moulds and a larger predetermined volume. As will be described in more detail in FIGS. 9 and 10**, an alternative or additional method of altering the predetermined volume accommodated by the through cavity is to interchange the volume block with a different volume block having a different sized through cavity, that is a through cavity with different dimensions.

A further advantage of embodiments of the present invention may be that the second valve needle is removable and interchangeable, because this allows the apparatus to process different sized batteries without having to substantially change the set-up of the machine. It is a very quick and simple procedure to remove one second needle valve and replace it with another which meets the requirements of the batteries to be processed.

Figures 8A, 8B:
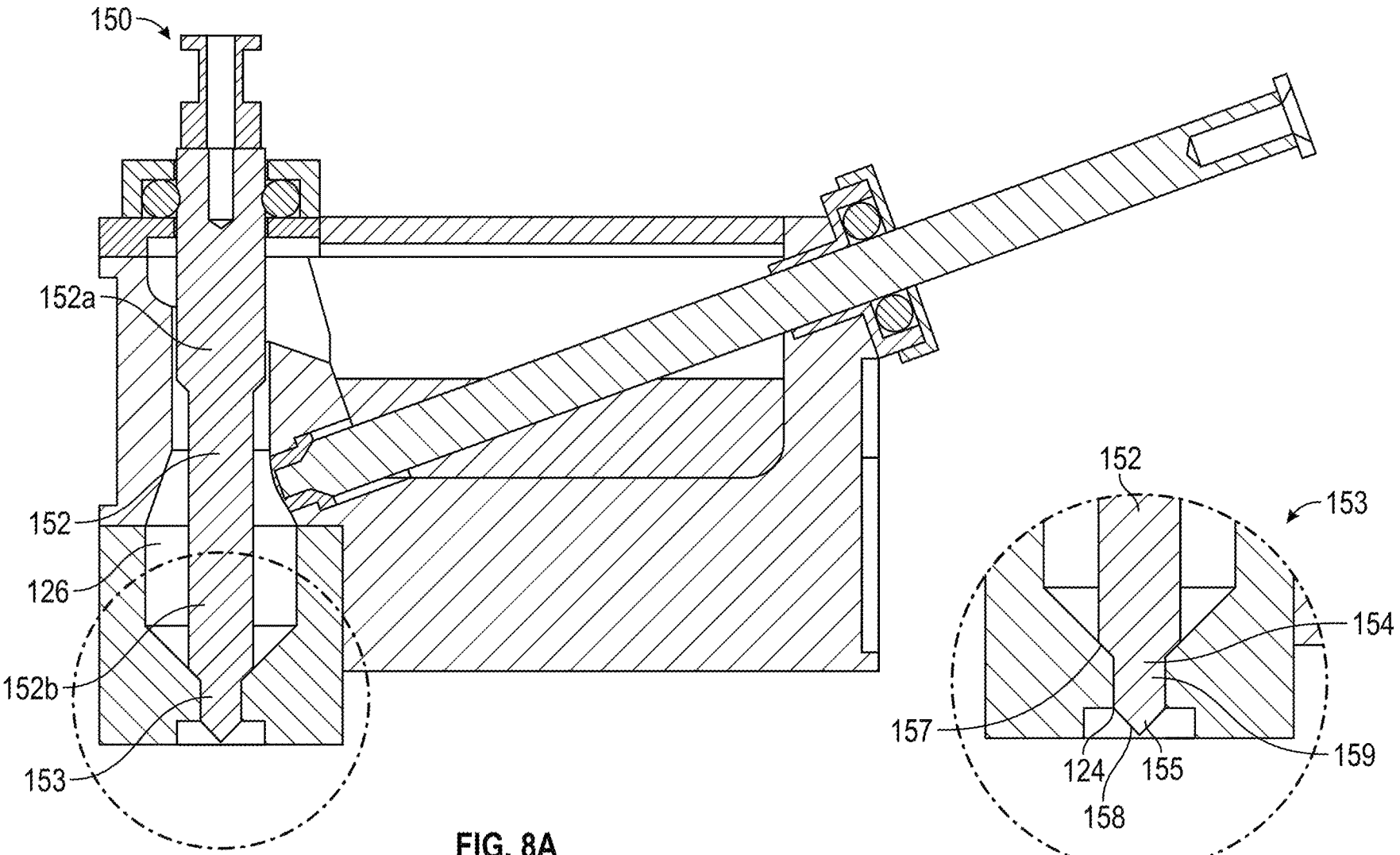
FIGS. 8*a* and 8*b* show the FIG. 7 lead delivery apparatus and a close-up view of a sealing mechanism which controls the flow of molten lead from a volume block in accordance with embodiments of the present invention.

FIG. **8*a* shows the same embodiment as FIG. 7, and FIG. 8*b* shows a close up of the relationship between the seat engaging portion 153 of the second needle valve 150 and the volume block outlet 124. The same relationship applies to all embodiments of the second needle valve (e.g. 50, 150), and as such this has previously been described above in FIGS. 1 and 2**, and will not be described again here.

Figure 9:
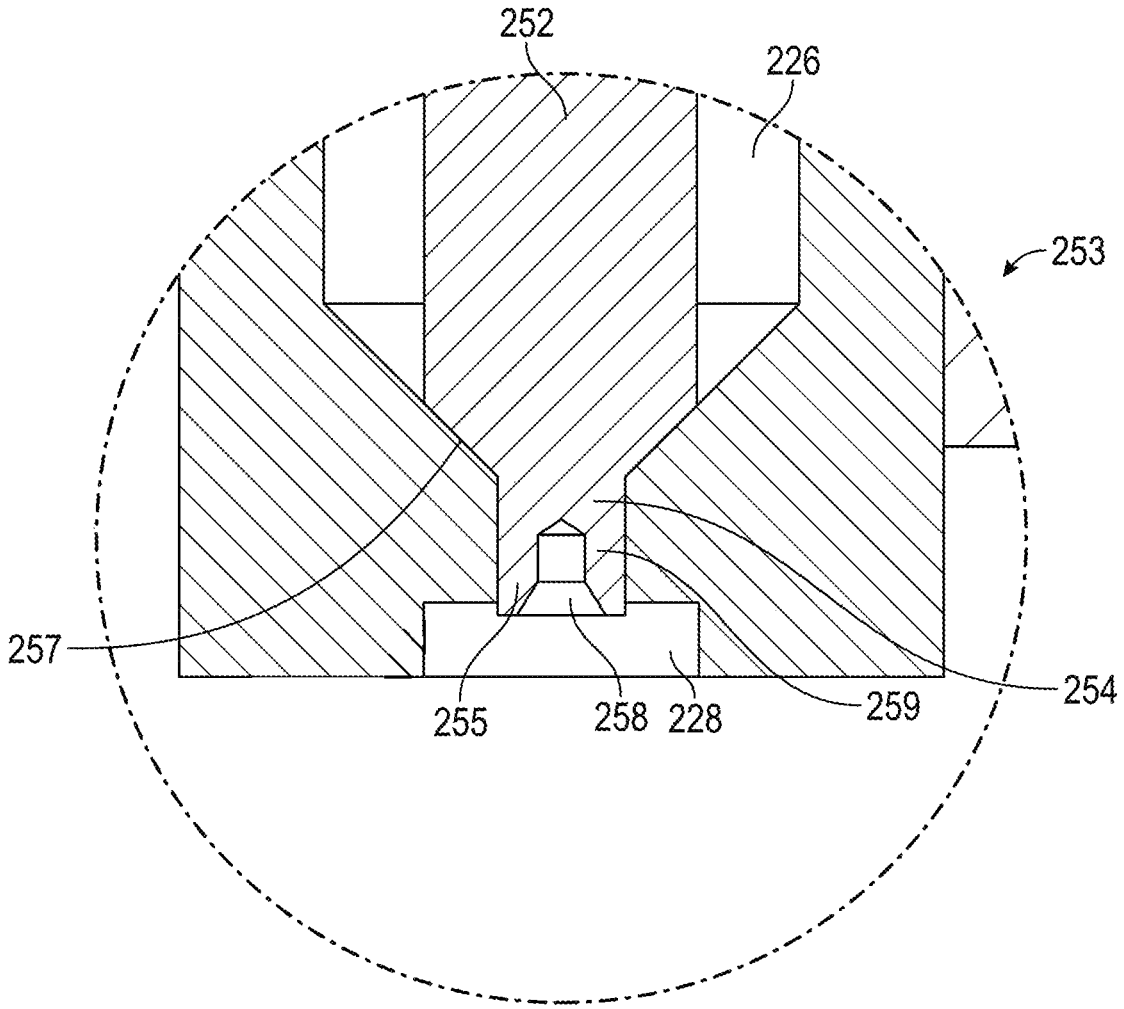
FIG. 9 shows a close-up view of a sealing mechanism which controls the flow of molten lead from a volume block mechanism in accordance with further embodiments of the present invention.

FIGS. 9, 10 and 11 all show a further embodiment of a second needle valve 250 located within a volume cavity 226. However, the apparatus works in exactly the same way as described above in FIGS. 3 to 6.

The second needle valve 250 comprises a seat engaging portion 253 and an elongate body 252. The seat engaging portion 253 comprises a first section 254 and a second section 255. The first section 254 comprises a first tapered portion 257 and a substantial part of an elongate portion 259, and the second section 255 comprises a second tapered portion 258 and the remaining part of the elongate portion 259.

In contrast to the embodiment shown FIGS. 2 to 8, the second tapered portion 258 extends internally into the elongate portion 259. The second tapered portion 258 forms a cavity within the elongate portion 259, as is best shown in FIG. 9. The cavity is typically machined using a centre drill, which gives the cavity its tapered shape. The widest part of the cavity 258 is at the base of the elongate portion 259, with the narrowest part, the tip of the second tapered portion 258, located internally within the elongate portion 259. The elongate portion 259 of the second section 255 protrudes into the recess 228 by 1 mm as before, but the second tapered portion 258 does not extend into the recess 228.

In use, the second needle valve 250 works in exactly the same way as second needle valves 50 and 150. Advantageously however, the profile of the second section 255 has been found to further reduce the amount of molten lead sticking to the surface of the second section in use, which may be because there is a smaller surface area onto which the molten lead could potentially stick. Such a profile may help to further prevent "tails" of molten lead hanging from the second section.

As mentioned above, if a different pre-determined volume is required, for example for moulding different sized battery straps, this can be achieved by switching the second needle valve for one having a different profile, and/or switching the volume block for one having a different through cavity dimensions.

FIGS. 10 and 11 show two different volume blocks 220 and 320. Through cavity 326 is shown to have larger dimensions (e.g. a larger diameter) compared to through cavity 226, thus through cavity 326 has a larger volume than through cavity 226. FIGS. 10 and 11 also show two different second needle valves 250 and 350. Second needle valve 350 has a larger profile, that is a larger diameter, than second needle valve 250. Both second needle valves 250 and 350 comprise a seat engaging portion 253 and 353 as shown in FIG. 9, and operate in the same way as described above.

FIG. 11 shows that the combination of volume block 320 with second needle valve 350 has a larger overall predetermined volume compared to the combination of volume block 220 with second needle valve 250. Thus, in this example, two different strap sizes can be moulded and cast on to different size batteries.

Typically, interchanging the volume block can provide a change of around 0.1 kg in the predetermined volume of the through cavity; and interchanging the second needle valve can provide a change of around 0.06 kg in the predetermined volume of the through cavity. Therefore, switching the volume block provides a course adjustment of the volume, whereas switching the second needle valve provides a finer adjustment of the volume.

It may be an advantage of embodiments of the present invention that having the option of interchanging the second needle valve and/or the volume block will provide the user with a much greater range of predetermined volumes to select from, thus the lead delivery apparatus is able to mould and cast on straps for a wide range of battery sizes.

Although the invention has been described above with reference to an exemplary embodiment, it will be appreciated that various changes or modifications may be made without departing from the scope of the invention as defined in the appended claims. For example, whilst embodiments have been described as having a single reservoir associated with a single volume block it will be appreciated by the skilled person that the invention is not limited to such an arrangement, for example a single reservoir may be provided with more than one outlet to supply a plurality of volume blocks.

The invention claimed is:

1. A lead delivery apparatus for a cast on strap machine arranged to deliver a predetermined volume of molten lead to a mould, the lead delivery apparatus comprising:

a needle valve comprising an elongate body and a seat engaging portion; and, a volume block defining an inlet, an outlet and a through cavity; the seat engaging portion being engageable with the volume block outlet;

the volume block inlet being in fluid communication with a supply of molten lead;

the through cavity together with the needle valve defining the predetermined volume of molten lead received from the supply of molten lead; and, the volume block outlet being selectively openable and closable by the needle valve;

wherein the seat engaging portion comprises a first section having a profile corresponding with a profile of the volume block outlet, such that the first section and the volume block outlet interlock when the volume block outlet is closed by the needle valve; and, a second section protruding beyond the volume block outlet when the volume block outlet is closed by the needle valve.

2. A lead delivery apparatus according to claim 1, wherein the seat engaging portion comprises a first tapered portion, and a second tapered portion; the first and second tapered portions being connected by an elongate portion.

3. A lead delivery apparatus according to claim 2, wherein the first section comprises the first tapered portion and a substantial part of the elongate portion.

4. A lead delivery apparatus according to claim 3, wherein the second section comprises the second tapered portion and a remaining part of the elongate portion.

5. A lead delivery apparatus according to claim 4, wherein the remaining part of the elongate portion protrudes beyond the volume block outlet by from around 0.5 mm to around 1 mm.

6. A lead delivery apparatus according to claim 2, wherein the second tapered portion extends internally into the elongate portion along a longitudinal axis of the elongate portion thereby defining a cavity within the elongate portion.

7. A lead delivery apparatus according to claim 2, wherein the second tapered portion extends externally away from the elongate portion along a longitudinal axis of the elongate portion.

8. A lead delivery apparatus according to claim 1, wherein the volume block outlet is located within a recess on an exterior surface of the volume block; and the second section protrudes into the recess when the volume block outlet is closed by the needle valve.

9. A lead delivery apparatus according to claim 1, further comprising a housing having a removable cover; the housing defining a reservoir, wherein the reservoir defines an inlet and an outlet; the reservoir inlet being in fluid communication with a molten lead supply.

10. A lead delivery apparatus according to claim 9, wherein the volume block inlet is in fluid communication with the reservoir outlet.

11. A lead delivery apparatus according to claim 9, wherein the housing defines a sealed ullage space extending over molten lead within the reservoir.

12. A lead delivery apparatus according to claim 11, wherein the through cavity of the volume block is in fluid communication with the ullage space.

13. A lead delivery apparatus according to claim 11, wherein a supply of inert gas is in fluid communication with the ullage space.

14. A lead delivery apparatus according to claim 9, comprising a further needle valve, and wherein the further needle valve extends through the housing and the reservoir.

15. A lead delivery apparatus according to claim 14, wherein the further needle valve is selectively moveable between a first position and a second position, such that in a first position the reservoir outlet is closed and any flow of molten lead between the reservoir and the volume block is prevented, and in a second position the reservoir outlet is open, such that any flow of molten lead between the reservoir and the volume block is permitted until an equilibrium position has been reached, which defines the predetermined volume.

16. A lead delivery apparatus according to claim 9, wherein the needle valve extends through the housing and the volume block.

17. A lead delivery apparatus according to claim 16, wherein the needle valve is selectively moveable between a first position and a second position, such that in a first position the volume block outlet is closed and any flow of molten lead between the volume block and a mould is prevented, and in a second position the volume block outlet is open, such that flow of a predetermined volume of molten lead is permitted between the volume block and the mould.

18. A lead delivery apparatus according to claim 1, wherein the elongate body comprises an upper section furthest from the seat engaging portion having a greatest diameter.

19. A lead delivery apparatus according to claim 18, wherein the elongate body also comprises a lower section between the upper section and the seat engaging portion having the same greatest diameter or one or more smaller diameters.

20. A lead delivery apparatus according to claim 18, wherein when the volume block outlet is closed by the needle valve, part of the through cavity immediately surrounding the upper section has a diameter such that a narrow clearance gap is defined between the upper section and said part of the through cavity.

* * * * *